US012343582B2

(12) United States Patent
Azenha et al.

(10) Patent No.: US 12,343,582 B2
(45) Date of Patent: Jul. 1, 2025

(54) EXERCISE DEVICE AND METHODS OF USING THE EXERCISE DEVICE

(71) Applicant: CINDERFIT LLC, Miami, FL (US)

(72) Inventors: Felipe Azenha, Miami, FL (US); Takeo Ishii, Miami, FL (US)

(73) Assignee: Cinderfit LLC, Miami, FL (US)

( * ) Notice: Subject to any disclaimer, the term of this patent is extended or adjusted under 35 U.S.C. 154(b) by 0 days.

(21) Appl. No.: 17/160,991

(22) Filed: Jan. 28, 2021

(65) Prior Publication Data

US 2022/0233906 A1 Jul. 28, 2022

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 23/04*** | (2006.01) |

(52) U.S. Cl.

CPC ..... *A63B 21/0604* (2013.01); *A63B 21/0607* (2013.01); *A63B 21/072* (2013.01); *A63B 21/4035* (2015.10); *A63B 23/0458* (2013.01)

(58) Field of Classification Search

CPC ..... A63B 21/0604; A63B 21/4035; A63B 23/0458; A63B 21/06–0607; A63B 21/072–075; E04B 1/04; E04B 1/08; E04B 1/12; E04B 1/348; E04B 1/34823; E04B 1/3483; E04B 1/34853; E04B 1/02–14; E04B 2/14; E04B 2/42; A63H 33/04–14; A63H 33/06; E04C 1/39; E04C 1/392; E04C 1/395; E04C 1/397

USPC ..... 52/596, 604, 606, 607; D25/113, 114, D25/118

See application file for complete search history.

(56) References Cited

U.S. PATENT DOCUMENTS

| | | | | | |
|---|---|---|---|---|---|
| 3,417,533 | A | * | 12/1968 | Sparling | E04B 2/18 52/607 |
| 3,483,574 | A | * | 12/1969 | Belnap | A61G 1/0293 312/213 |
| 4,515,364 | A | | 5/1985 | Rotella | |
| 4,575,074 | A | | 3/1986 | Damratoski | |
| 4,673,179 | A | * | 6/1987 | Pengler | A63B 21/072 482/148 |
| D315,003 | S | | 2/1991 | Huang | |

(Continued)

FOREIGN PATENT DOCUMENTS

| | | | | |
|---|---|---|---|---|
| GB | 2451844 A | | 2/2009 | |
| GB | 2526530 A | * | 12/2015 | A63B 21/00047 |

OTHER PUBLICATIONS

Power Systems Document (derived from: Power Systems, "Premium Power-Plyo Box" [online], Web Archive Sep. 20, 2020 [ retrieved on Jun. 15, 2020], Retrieved from: https://web.archive.org/web/20200920004750/https://www.power-systems.com/shop/product/premium-power-plyo-box) (Year: 2020).*

(Continued)

*Primary Examiner* — Loan B Jimenez
*Assistant Examiner* — Catrina A Letterman
(74) *Attorney, Agent, or Firm* — Laurence A. Greenberg; Werner H. Stemer; Kerry P. Sisselman

(57) ABSTRACT

An exercise device is provided having a top face and an open framework body, in which the interior of the body is open, and the faces of the open framework body are defined, at least in part, by hand grips formed at the intersections between the faces of the body. The faces are open between hand grips.

16 Claims, 8 Drawing Sheets

(56) References Cited

U.S. PATENT DOCUMENTS

| | | | | |
|---|---|---|---|---|
| 5,120,253 | A * | 6/1992 | Gelardi | A63H 33/10 446/77 |
| 5,180,323 | A * | 1/1993 | Justice | A63H 33/062 446/120 |
| 5,316,528 | A * | 5/1994 | Ziparo | A63B 21/4029 482/52 |
| 5,403,258 | A * | 4/1995 | Hill | A63B 23/0211 482/145 |
| 5,716,305 | A | 2/1998 | Selsam | |
| 7,011,611 | B1 * | 3/2006 | Ripley | A63B 21/0728 482/107 |
| 7,553,259 | B2 | 6/2009 | Landfair | |
| 8,496,565 | B2 | 7/2013 | Rothacker | |
| 9,272,226 | B2 * | 3/2016 | Samlaska | A63H 23/005 |
| 9,814,421 | B2 * | 11/2017 | Edwards | A61B 5/221 |
| 9,925,408 | B1 * | 3/2018 | Murdock | A63B 21/00047 |
| 9,937,373 | B2 * | 4/2018 | Gvoich | A63B 21/4035 |
| 10,188,892 | B1 * | 1/2019 | Gvoich | A63B 21/4035 |
| 10,315,064 | B2 | 6/2019 | Pinkus | |
| D878,496 | S | 3/2020 | Hoppe | |
| 2006/0025035 | A1 * | 2/2006 | Glickman | A63H 33/102 446/124 |
| 2007/0167301 | A1 | 7/2007 | Evans | |
| 2007/0238578 | A1 * | 10/2007 | Landfair | A63B 21/072 482/44 |
| 2009/0023563 | A1 | 1/2009 | Liang | |
| 2009/0163329 | A1 | 6/2009 | Pearce | |
| 2010/0004105 | A1 | 1/2010 | Peddar | |
| 2012/0240482 | A1 * | 9/2012 | Pitt | B66C 1/66 52/745.03 |
| 2013/0137558 | A1 * | 5/2013 | Ross | A63B 5/16 482/142 |
| 2013/0172160 | A1 * | 7/2013 | Poole | A63B 23/0458 482/129 |
| 2014/0024505 | A1 * | 1/2014 | Potts | A63B 21/072 482/106 |
| 2014/0352247 | A1 * | 12/2014 | Thompson | E04C 1/397 52/505 |
| 2017/0232357 | A1 * | 8/2017 | Rosen | A63H 33/046 446/92 |
| 2018/0243597 | A1 * | 8/2018 | Schlegel | A63B 69/34 |
| 2019/0009121 | A1 * | 1/2019 | Briggs | A63B 21/4027 |
| 2019/0126122 | A1 * | 5/2019 | Vester | A63B 21/4029 |
| 2019/0168060 | A1 | 6/2019 | Laurence | |
| 2019/0175979 | A1 * | 6/2019 | Towley, III | A63B 71/0036 |
| 2019/0262738 | A1 * | 8/2019 | Hyslop | A63H 33/105 |
| 2020/0001127 | A1 * | 1/2020 | Hume | A63B 23/1218 |
| 2020/0240132 | A1 * | 7/2020 | Barreto | A47B 87/008 |
| 2020/0246657 | A1 * | 8/2020 | Wittenbrink | A63B 21/4033 |
| 2021/0138289 | A1 * | 5/2021 | Jones | A63B 5/16 |
| 2021/0170218 | A1 * | 6/2021 | Lewis-Dove | A63B 21/4047 |
| 2021/0310232 | A1 * | 10/2021 | Ebisu | E04B 1/6162 |
| 2022/0042300 | A1 * | 2/2022 | Van Ee | E04B 1/34331 |
| 2022/0105383 | A1 * | 4/2022 | Mugulusi | A63B 21/0728 |

OTHER PUBLICATIONS

Best Choice Amazon listing (derived from:https://www.amazon.com/Best-Choice-Products-Industrial-Rectangular/dp/B084H1WTJM?source=ps-sl-shoppingads-lpcontext&ref_=fplfs&smid=A2GUMCXR7HBXM2&gQT=1&th=1; Date first available: Feb. 3, 2020) (Year: 2020).*

IRONCK Amazon listing (derived from: https://www.amazon.com/IRONCK-Entryway-Console-Entertainment-Industrial/dp/B083S8WB76/ref=pd_ci_mcx_pspc_dp_2_i_1?pd_rd_w=St8ai&content-id=amzn1.sym.cd152278-debd-42b9-91b9-6f271389fda7&pf_rd_p=cd152278-debd-42b9-91b9-6f271389fda7&pf_rd_r . . . (Year: 2020) =CYQ1HFVDQMPWHP79E60X&pd_rd_wg=39KWo&pd_rd_r=8c66527f-f87b-4462-81ca-463a5c319d96&pd_rd_i=B083S8WB76&th=1; Date first available: Jan. 12, 2020) (Year: 2020).*

Geneva Amazon listing (derived from: https://www.amazon.com/Lakeside-Geneva-Veneer-Spice-Serving/dp/B004PSZ1PM/ref=sr_1_3?dib=eyJ2IjoiMSJ9. QhDkpHs34bWbtxDdVclgVtN1uMTSXu2ElanCLLNm6enVUcPmvdoKbkHsKXdXJQvPvsSq1EdhRfd2n3HDxINMzCmPF6oLx3uns5zHRzjtYtLehmRqifZWps8rKVI7-1Y0BrPVvtJMDKmyZo . . . (Year: 2010) XVKCPpnTKUzPU8ii_6q_QMfzWC3_UFXOwrIPMWKORcdVjURtgbTq-8SqOolTzokythRodDUe2pqpERxs8BryWk1SLHWMs3V6yHK6cJ9WDLKT9AmhdFHPpOg8IzXPUfxC4gX1sJKYNA-LCmDcZ5-zwGIRCI1FOLIV59HPL8E4hjEfQ3VFkhsB32a6kqHSESRLOvX60L-jJdMi7zhTKRbTXSYMK6padnz4a9txyS44rqXjbbgXCFRFRCBeH905P5pFB . . . (Year: 2010) Z-ILFNObjSHgS5lKytnqDPUJJg_szDhmt5kKX1InhFR8TdJ9.pqGVcTTuEJcYsCs1EGJ_zCL7YcNv6Gtn_TXXUtcMIJk&dib_tag=se&keywords=geneva+by+lakeside+serving+cart&qid=1737700468&sr=8-3; Date first available: Oct. 27, 2010) (Year: 2010).*

Acme Store Amazon listing (derived from: https://www.amazon.com/dp/B077JHQRDG/ref=sbl_dpx_coffee-tables_BODGPGRHHJ_00?th=1; Date first available: Nov. 16, 2017) (Year: 2017).*

Jenny Sugar, "This Is the 30-Minute Full-Body Workout I've Been Doing Using Just My Coffee Table" [online], Aug. 13, 2020 [retrieved on Jan. 23, 2025], POPSUGAR, Retrieved from: https://www.popsugar.com/fitness/30-minute-coffee-table-workout-47387267#photo-47580920) (Year: 2020).*

* cited by examiner

EXERCISE DEVICE AND METHODS OF USING THE EXERCISE DEVICE

BACKGROUND OF THE INVENTION

Field of the Invention

The invention relates generally to an exercise device and a method of using the exercise device. More particularly, a weighted, rectangular exercise device is provided that is useful to assist in performing a number of exercises.

Description of the Related Art

Weighted exercise devices are known. One such weighted exercise device is a kettlebell. In one particular form, a kettlebell is a cast iron or cast steel ball (i.e., the "bell") with a handle attached to the top, which is used for performing various exercises. However, the number and types of exercises that can be performed using a kettlebell are limited by its form.

Common objects have also been repurposed for weight training. For example, exercises have been devised using cinder blocks, sandbags, PVC pipe and utility buckets, among others. Cinder blocks, in particular, have been repurposed to perform such exercises as cinder block presses, where the user holds a cinder block with each hand and presses them directly overhead, repeatedly. Exercises using cinder blocks additionally include cinder block squats, lunges, deadlifts, bench dips, step-ups, among others. The shape and form of cinder blocks permits them to be used in place of other objects in weight training, as well. For example, cinder blocks can be used for performing kettlebell swings and snatches, in place of kettlebells, farmers carries, in place of utility buckets, and plyo jumps and step-ups, in place of plyo blocks. Cinder blocks, however, are formed with front and rear openings, only, thus providing a limited place to grip them. See, for example, FIG. 1. Additionally, they are made from concrete and are, thus, rough to touch and handle, and can be broken.

U.S. Pat. No. 4,673,179 to Pengler discloses an exercising device comprising a geometrically regular body including a plurality of polygonally-shaped flat sides and a plurality of spaced handle means, as shown in FIG. 2, herein. The handle means are defined by at least two elongated spaced openings in the surface of the body which flank the intersection between two of the flat sides. These openings cooperate with at least the remaining portion of the surface intervening therebetween to define elongated graspable hand-holds at the facial intersections. Pengler discloses that the device, in accordance with that invention, may comprise a cube, or other attractive geometric shape, such as a pyramid. The large, relatively closed facial portions of Pengler, present on all sides of the device, result in the device being complicated to make, resulting in a higher than necessary expense.

What is needed is an exercise device that has a similar form to a cinder block, thus permitting its versatility in use, yet is easy to handle, and easy to grip, thus increasing the versatility, and resists breaking. What is further needed is an exercise device that provides a fairly open framework, having open facial portions between hand grips, so as to be less complicated to make and/or use.

SUMMARY OF THE INVENTION

It is accordingly an object of the invention to provide an exercise device and methods for using the exercise device that addresses the needs set forth above. In one particular embodiment of the invention, an exercise device is provided that has a rectangular body with top, bottom, side, and end faces. In one preferred embodiment, the interior of the body is open, and the faces are defined by bars or hand grips formed at the edges between faces. In one particular embodiment, at least one side face of the exercise device is bisected by an additional hand grip.

Particular methods for using an exercise device in accordance with the present application are additionally provided.

Other features which are considered as characteristic for the invention are set forth in the drawings, description and appended claims.

Although the invention is illustrated and described herein as embodied in an exercise device and methods for using the exercise device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which like reference numerals represent like items.

DETAILED DESCRIPTION OF THE INVENTION

Figure 1:
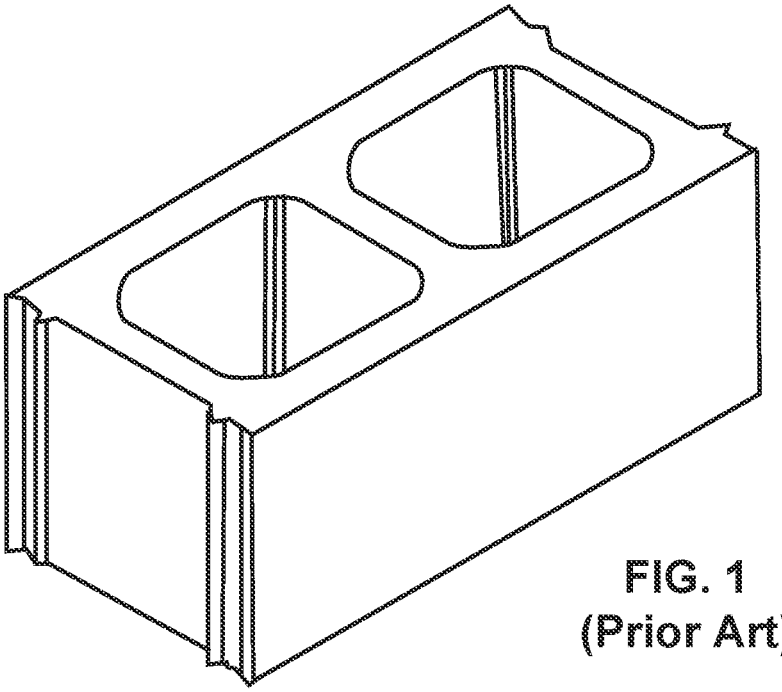
FIG. 1 (Prior Art)
FIG. 1 is a perspective view of a cinder block in accordance with the prior art.
Figure 2:
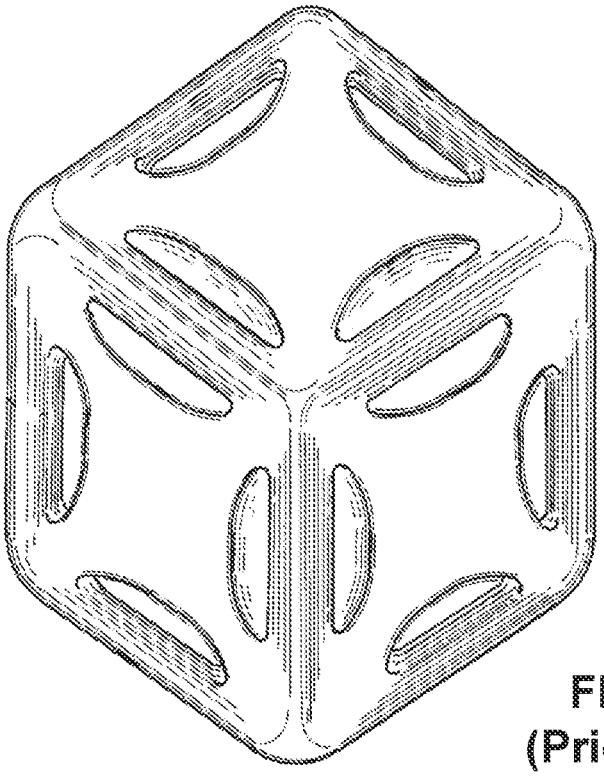
FIG. 2 (Prior Art)
FIG. 2 is an external perspective view of an exercising device in accordance with the prior art.
Figure 3:
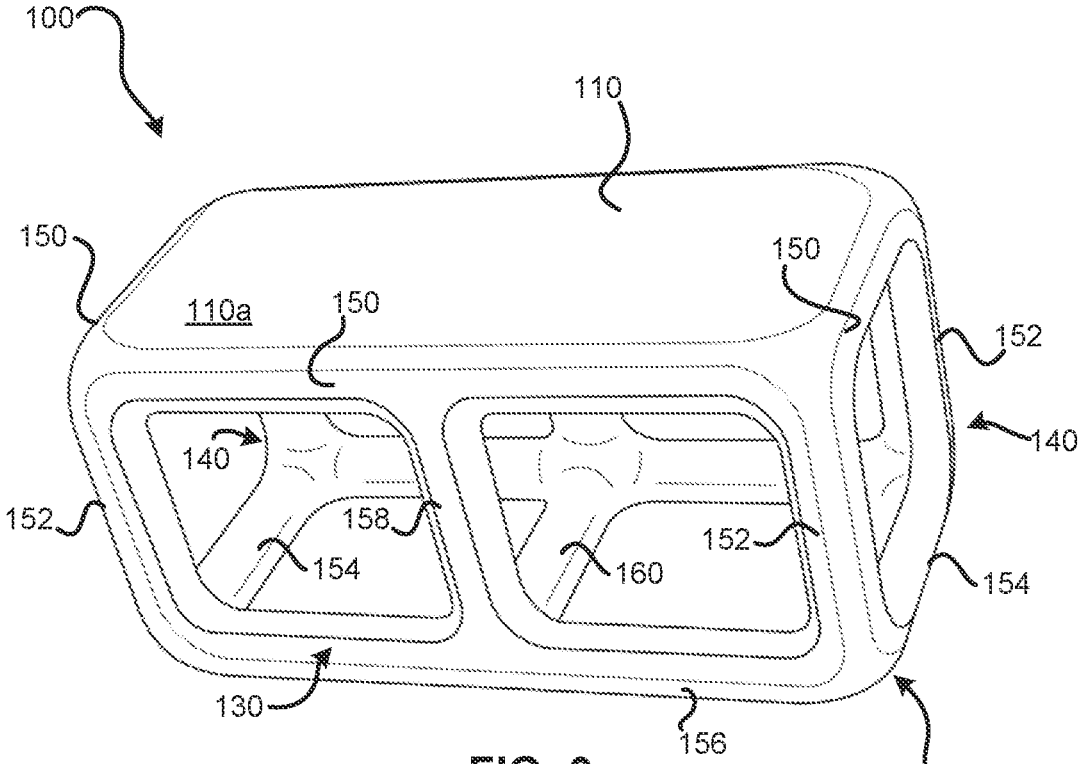
FIG. 3 is a perspective view taken from the top, of an exercise device in accordance with one particular embodiment of the present invention.
Figure 4:
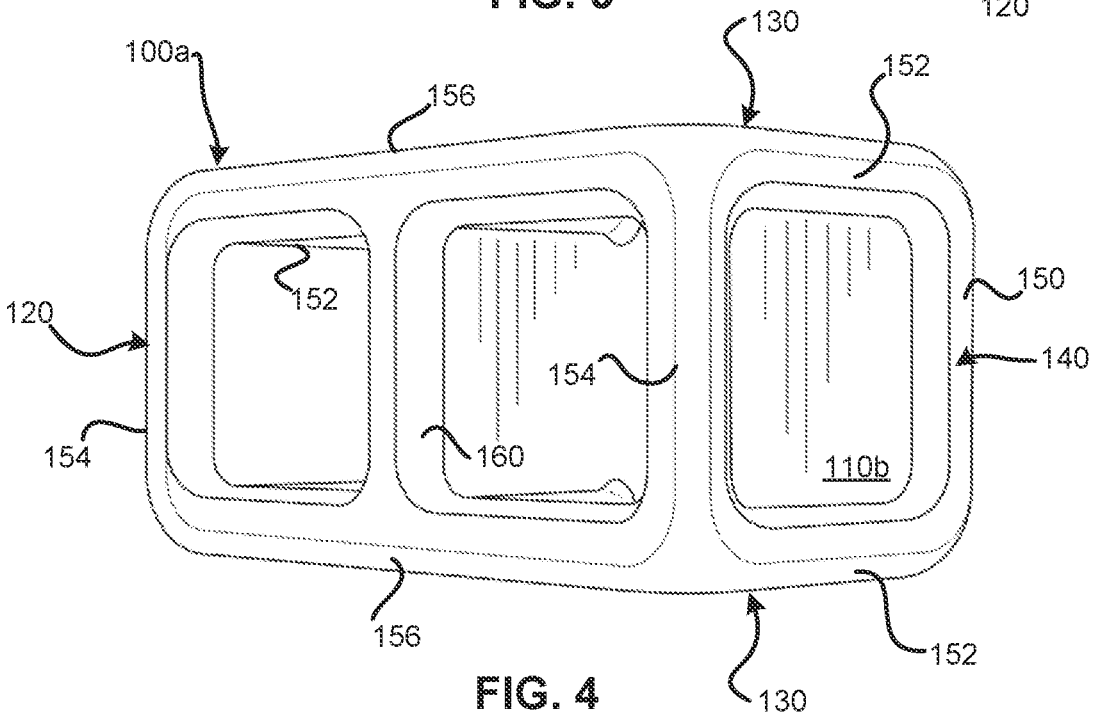
FIG. 4 is a perspective view taken from the bottom of the exercise device of FIG. 3.
Figure 5:
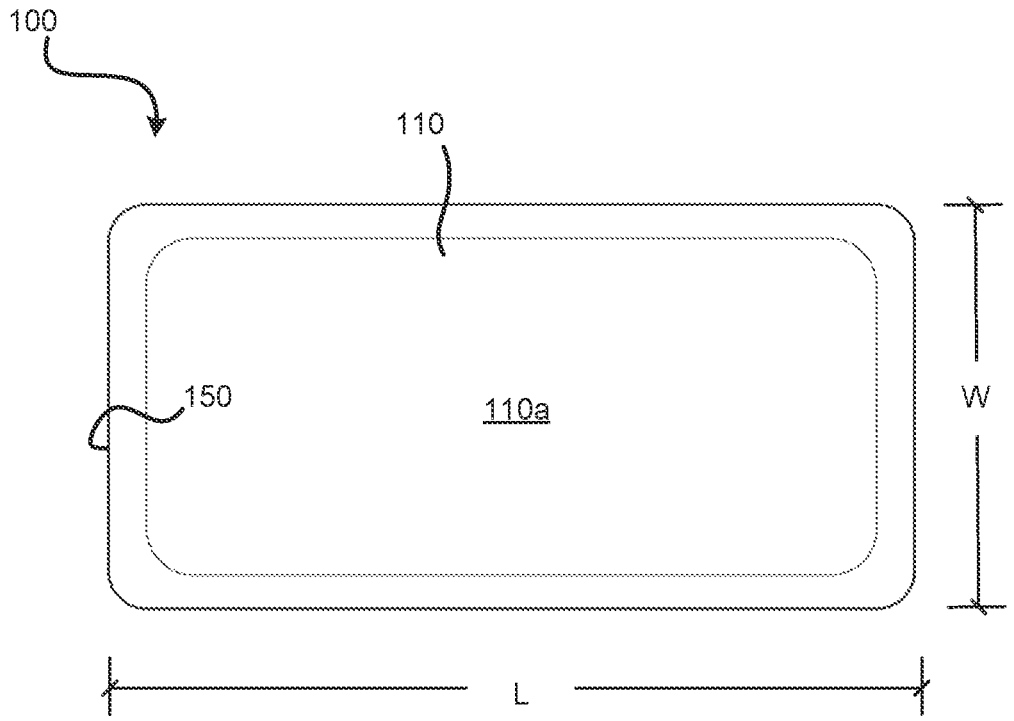
FIG. 5 is a side plan view of the exercise device of FIG. 3.
Figure 6:
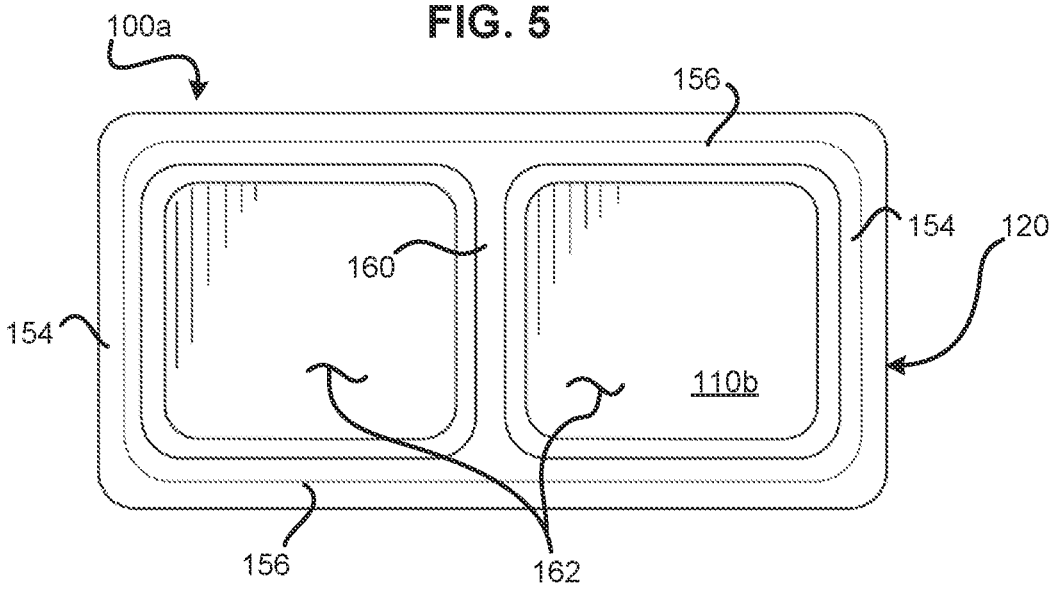
FIG. 6 is a bottom plan view of the exercise device of FIG. 3.
Figure 7:
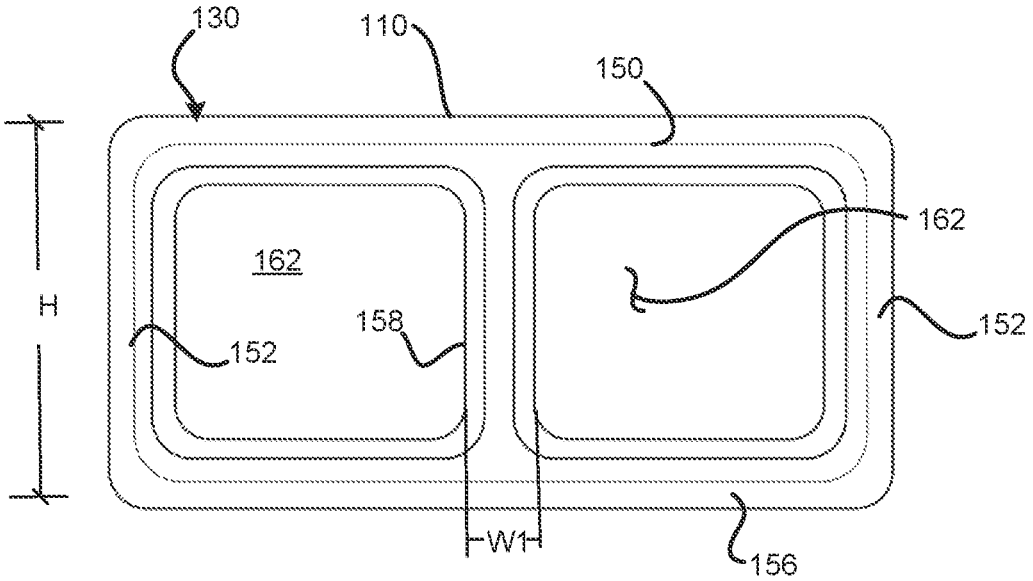
FIG. 7 is a top plan view of the exercise device of FIG. 3.
Figure 8:
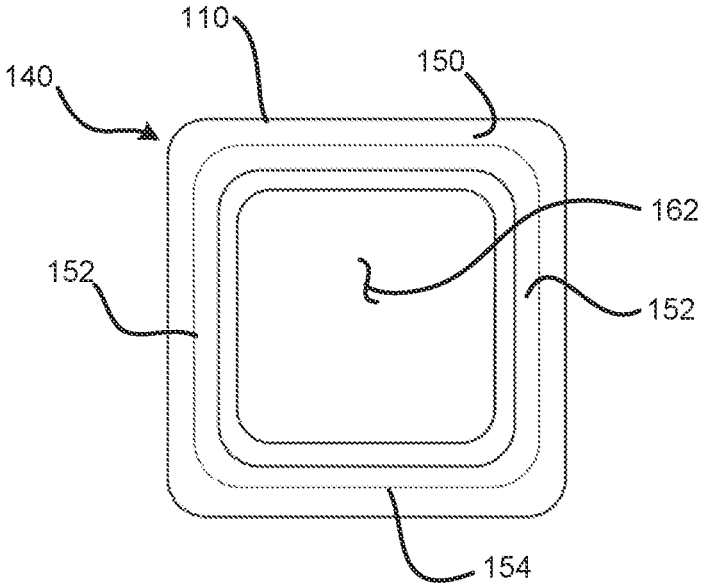
FIG. 8 is an end plan view of the exercise device of FIG. 3.
Figure 9:
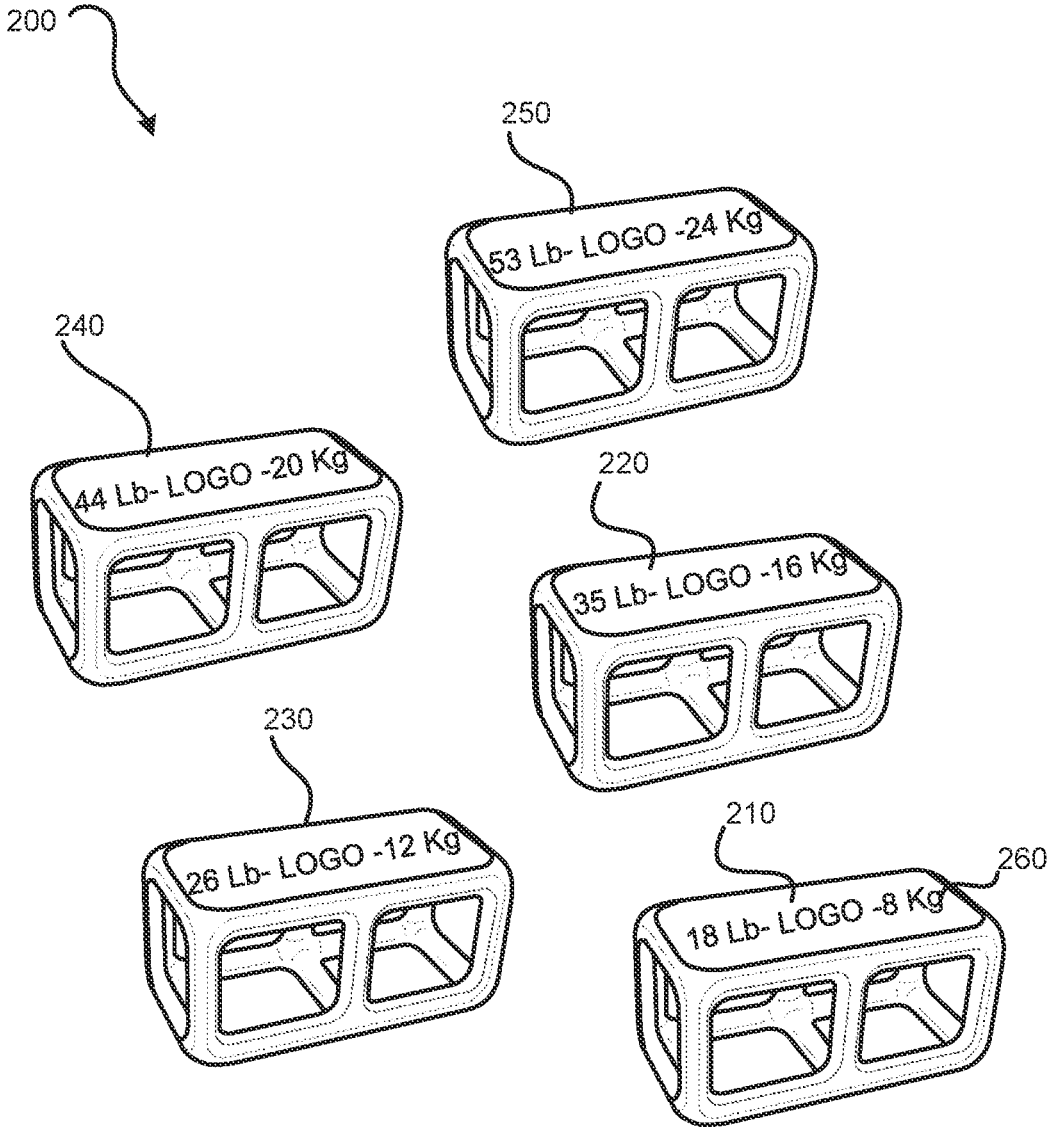
FIG. 9 is an illustration of a system of exercise devices in accordance with one particular embodiment of the invention.

Referring now to FIGS. 3-8, an exercise device 100 according to one particular embodiment of the present invention will now be described. The exercise device 100 has a rectangular body (i.e., in one particular embodiment, the exercise device 100 is shaped as a right rectangular prism), formed by an enclosed top face 110 and an open framework 100*a* extending off from the enclosed top face 110. As a consequence of this open framework, the exercise device 100 has a hollow center, and large open facial portions between its hand grips, making it easy to grip and hold the exercise device 100, as well as forming a sturdy support structure for the exercise device 100. Additionally, such a configuration permits the body of the exercise device 100 to be manufactured as a single piece, for example, through molding and/or casting.

The open framework 100*a* is formed by first and second side faces 130, extending from the top face 110 in the length direction L, and substantially perpendicular to the top face 110; first and second end faces 140 extending from the top face 110 in the width direction W, and substantially perpendicular to the top face 110; and a bottom face 120 that is substantially parallel to the top face 110. Each of the faces 120, 130, 140 of the framework 100*a* is defined by bars or "hand grips" at the intersections between contiguous sides of the framework 100*a*. For purposes of the present application, the term "hand grips" is intended to encompass a bar or grip of the exercise device 100, that can be wrapped around by the hand of a user. In the present preferred embodiment, the faces 120, 130, 140 of the open framework 100*a* are open between hand grips.

More particularly, in the illustrated preferred embodiment, the closed top face 110 of the exercise device 100 is a solid, unpierced face having an outwardly facing front surface 110*a*, and an inwardly facing back surface 110*b*. The top face 110 is closed, in the present embodiment, to provide a face that can be stepped on, for example, during step-ups, heel taps, balance and/or other exercises. Additionally, the closed top face 110 provides for some air resistance when the exercise device 100 is used for certain exercises, such as kettlebell swings. Although the edges of the top face 110 can be gripped by the hand of a user, in order to improve grip strength, those edges are not "hand grips", as that term is used in the present application, as the hand of the user cannot wrap "around" them.

The open framework body 100*a* of the exercise device 100 is formed as a framework of bars or hand grips at each intersection between two contiguous faces of the body 100*a*. Additional hand grips may be provided, as desired, as will be described in connection with the side and bottom faces 120, 130. However, it should be noted that, in the present preferred embodiment, the faces 120, 130, 140 of the open framework body 100*a* are open between hand grips, for easy gripping and use, as well as for ease of manufacture.

Figure 12:
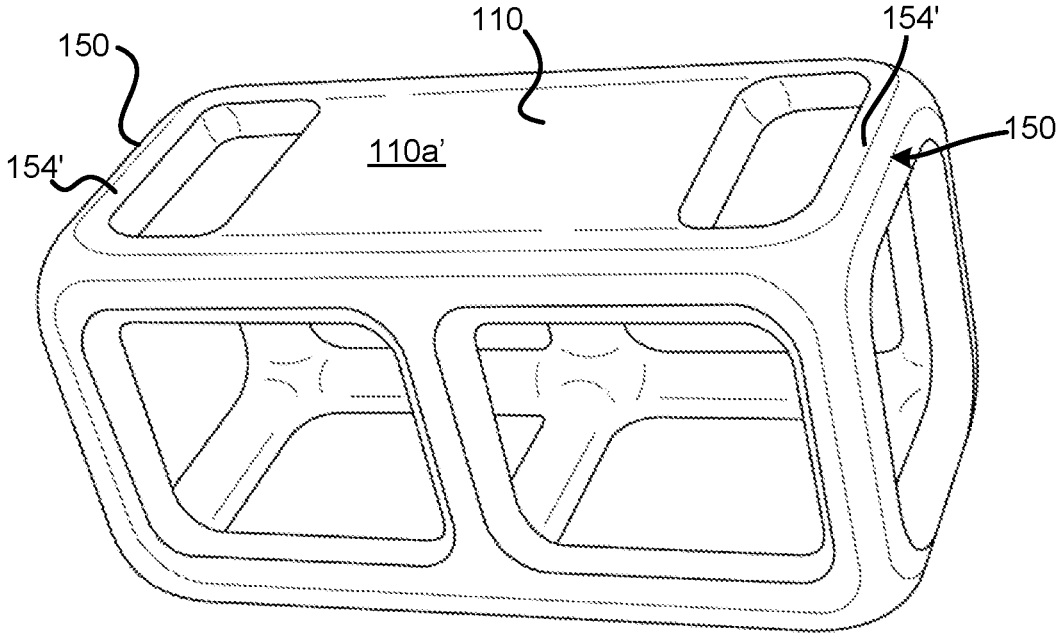
FIG. 12 is a perspective view taken from the top, of an exercise device in accordance with an alternate embodiment of the present invention.

More particularly, in the present embodiment illustrated, the top edge 150 of each of the side faces 130 and end faces 140 is that face's respective intersection with the top face 110, and is, in fact, an edge of that top face 110. In particular, each edge 150 can be an end face of the closed top face 110 (i.e., where the thickness of the edge 150 is the thickness of the top face 110 between the surfaces 110*a* and 110*b*). Alternately, the top face 110 can include a lip that extends down from the top face 110, as desired. Thus, in the present illustrated embodiment, the top edges (i.e., at the top face 110) do not form hand grips. In an alternate embodiment illustrated in FIG. 12, the top face 110 can be pierced to form hand grips 154' at the edges 150 of the top face 110, if desired, but with the remaining portion 110*a'* of the top face 110 being closed.

As discussed above, the remaining portions of faces 120, 130, 140 are formed by bars or hand grips at each intersection between two contiguous faces. For example, each end face 140 is defined by the top edge 150 of the top face 110, by two vertical hand grips 152 at the facial intersections between each end face 140 and the two contiguous side faces 130 adjacent to the respective end face 140, and by a horizontal hand grip 154 at the facial intersection between the respective end face 140 and the contiguous bottom face 120.

Similarly, each side face 130 is formed by the top edge 150 (shared with the enclosed top face 110), by two vertical hand grips 152 (at the intersection with each contiguous end face 140), and by a horizontal hand grip 156 that is formed at the facial intersection between the respective side face 130 and the contiguous edge of the bottom face 120. Correspondingly, the bottom face 120 is defined by the horizontal hand grips 154 formed at the facial intersections of the bottom face 120 with each end face 140, and the horizontal hand grips 156 formed at the facial intersections of the bottom face 120 with each side face 130.

It is intended that the faces 120,130, 140 of the open framework 100*a* of the present embodiment be open between hand grips (i.e., do not contain a closed face between hand grips). In other words, the faces are completely open between hand grips. Note that, if desired, additional hand grips may be provided as part of the faces 120, 130, 140. For example, in the present preferred embodiment, each of the sides 130 includes a further bar or hand grip 158, connected between the bottom edge or hand grip 156 and the top edge 150, and bisecting that face 130. In keeping with the goal of having open faces between hand grips, the space between the hand grip 158 of each side face 130 and each vertical hand grip 152 of that side, are completely open (i.e., do not contain a closed face between the hand grips 152 and 158). As such, for purposes of this application, "open between hand grips" or "completely open between hand grips" includes the case where there is a central hand grip that is not at an intersection between two faces, and the face is still "completely open between handgrips", i.e., between handgrips 152 and 158 on either side of the central hand grip 158; or 154 and 160 on either side of the central hand grip 160. In other words, each face is intended to have at least one open window area 162 between two hand grips to facilitate easy use of the exercise device 100, as well as its manufacture.

Additionally, in contrast to the construction of a cinder block, the interior of the body 100*a* is open, as well. For example, there is no closed face connecting the hand grips 158 of each side 120, through the body of the device 100.

Similarly, in the present preferred embodiment, the bottom face 120 also includes a further bar or hand grip 160, connected between the lengthwise edges 156, which bisects that face 120. As with the side faces 130, the bottom face 120 is open between each hand grip 154 and central hand grip 160, and through the interior of the body 100*a* (i.e., from the hand grip 160 to the inner surface 110*b* of top face 110).

Thus, in the open framework of the body 100*a*, each face 120, 130, 140 is defined by edge 150 and/or the hand grips 152 and 154 arranged as a frame or open windowpane around a completely open, central space 162. In the illustrated embodiment, including the central hand grips 158 and 160, those faces 120, 130 are still open between hand grips 152 and 158, or 160 and 154, with each face 120, 130 forming an open, double-frame or windowpane including two open or empty spaces 162. Such a configuration makes it easy to grasp the exercise device 100 from a middle portion of the device 100, better distributing the weight of the device 100 for certain exercises.

In one particular embodiment of the invention, the exercise device 100 has roughly the same dimensions as a typical cinder block. In another particular embodiment of the invention, the length L of the exercise device 100 is approximately 400 mm. In that same embodiment, the width W of the exercise device 100 and the height H of the exercise device 100 are each approximately 200 mm, thus providing a 2:1 ratio of length L to width W or height H. Note that the invention is not meant to be limited only to a device having these dimensions, but rather, other size devices, or devices having other relative proportions can be made without departing from the scope and spirit of the invention. Additionally, in one particular embodiment of the invention, the width W1 of the central hand grip 158 and/or the central hand grip 160 is 35 mm. Further, in one particular embodiment, each of the hand grips 152, 154, 156, 158 and 160 have a width of approximately 35 mm.

The exercise device 100 can be sold individually, or as part of an exercise system. For example, in one particular embodiment of the invention, a system is provided that includes two or more exercise devices 100, having different weights and/or dimensions.

Referring now to FIGS. 3-9, in one particularly preferred embodiment of the invention, a system 200 of exercise devices 210, 220, 230, 240, 250 are provided in which the system 200 includes two or more exercise devices 100 having different weights, but otherwise identical physical dimensions. Exercise devices 100 having different weights, but the same dimensions can be made using different materials, for example. Each exercise device of the system 200, can have the same form as that described in connection with exercise device 100, if desired. In one particular embodiment of the invention, exercise devices 210, 220, 230, 240, 250 have weights of 8 Kg (18 Lb), 12 Kg (26 Lb), 16 Kg (35 Lb), 20 Kg (44 Lb), and 24 Kg (53 Lb), respectively. Each exercise device 100, 210, 220, 230, 240, 250 can be marked with an indicia 260 indicating the weight of the device, as well as other indicia, such as a name, trademark, logo and/or a graphic. The weight and/or other indicia 260 can be marked on the front surface 110*a*, and the same, or a different indicia can also be marked on the back surface 110*b*, if desired. Although described as part of a system 200, it should be understood that the exercise devices 100, 210, 220, 230, 240, 250 can be obtained individually, and not as part of a set, without departing from the scope or spirit of the present invention.

The exercise devices 100, 210, 220, 230, 240, 250, can be made out a variety of materials to achieve the desired weights and strengths. As discussed above, different ones of the exercise devices 100, 210, 220, 230, 240, 250 can be made from different materials than other ones of the exercise devices 100, 210, 220, 230, 240, 250, in order to achieve different weights, while maintaining the same dimensions as one another.

For example, in one particular embodiment of the invention, an 8 Kg (18 Lb) weight 210 is made using a cast metal base insert, such as a cast iron base insert, that is overmolded with rubber to meet the desired weight and dimensions. The overmolded rubber and/or any exposed portions of the insert can be painted to have a particularly desired finish color, pattern and/or marking indicia. A transparent UV coating can be applied over the paint, for protection. As discussed above, an indicia 260 can be provided in the top surface 110*a* and/or the bottom surface 110*b* of the exercise device. This indicia 260 can be provided by paint, ink, stamping, cutting, debossing and/or molding on or into an outer coating of the exercise device 210, as desired. Other indicia can be provided on the exercise device 210, as desired. Note that other types of materials and/or metals can be used for the base insert, without departing from the scope or spirit of the present invention. For example, instead of cast iron, other materials including, but not limited to, steel, aluminum, ceramic, concrete, plastic, etc., can be used, as desired.

Heavier exercise devices can be provided using a thicker, heavier insert and less overmolding, as desired. For example, the exercise device 220, weighing 12 Kg (26 Lb) can be made in the same way as described in connection with exercise device 210, but using a thicker, heavier metal insert (i.e., made with more metal), while using less rubber overmolding, to achieve a greater weight, while maintaining the same dimensions as the lighter weighted exercise device 210. Thus, in one particular embodiment of the invention, each of the exercise devices 210, 220, 230, 240, 250 starts with a differently weighted insert (having different amounts of the cast metal or other material, in the present embodiment), and is then appropriately overmolded to result in the exercise device having the same physical dimensions as the others in the system. If desired, differently weighted devices 100, 210, 220, 230, 240, 250 can be painted different colors, or be overmolded with different rubber colors, in order to further visually distinguish the devices 100, 210, 220, 230, 240, 250 from one another.

The exercise devices 100, 210, 220, 230, 240, 250 of the present invention can be used in connection with a variety of exercises. Their shape and size make them adaptable to a variety of different types of exercises. For example, some of the exercises that lend themselves well the exercise device of the present invention include, but are by no means limited to:

Squats: Front, back, overhead and/or thruster squats can be performed while holding the exercise device 100 by an opposing pair of hand grips 152 or 154. More particularly, the exercise device 100 can be held in front of, behind and/or above the head of a user or dynamically lifted (i.e., thrust) above the head of a user while the user lowers his hips from a standing position, down to a squatting position, and back to a standing position. Other types of squats, such as the weighted pistol (wherein one leg of the user is raised and pointed outward during the squat) can also be performed using the exercise device 100, held by the hand grips 152 or 154. The exercise device 100 can additionally be used to perform single arm squats and single arm squat snatches using one of the center hand grips 158 or 160 to hold the exercise device 100 on the shoulder, while the squat is performed.

Figure 10A:
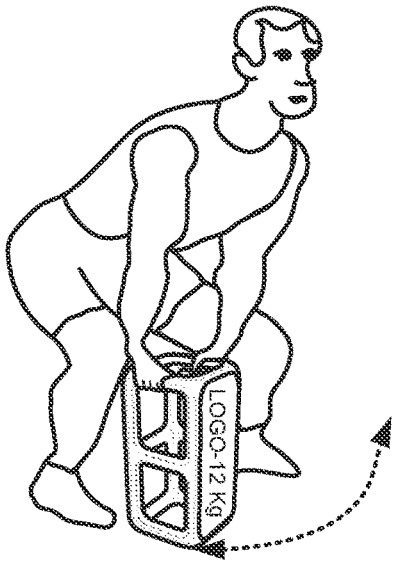
FIGS. 10A-10E are illustrations useful in understanding a method of using an exercise device in accordance with one embodiment of the invention for performing an exercise.
Figure 10B:
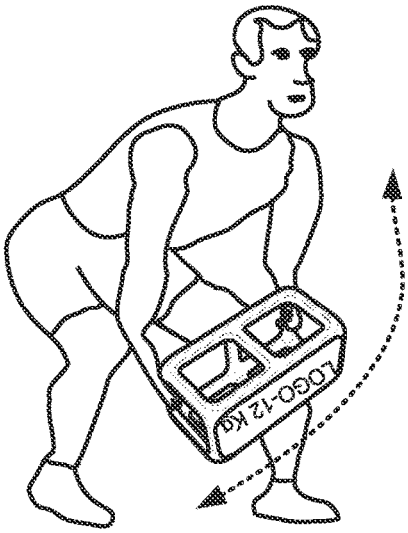
Figure 10C:
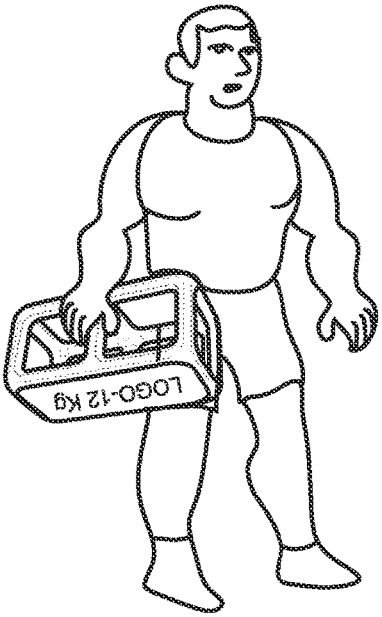

Deadlifts and other lifts: The user can place the exercise device 100 on the floor, with the top face 110 down, and perform two handed deadlifts while grabbing the hand grips 154 to lift the exercise device 100 off the ground, while the user moves from a squatting position to a standing position and back. Other types of two handed lifts can be similarly performed by grasping an opposing pair of hand grips 154 (see, for example, FIG. 10B), or even an opposing pair of the top edges 150, if desired, including, but not limited to a clean lift and/or a clean and jerk, a shoulder press, a push press, a push jerk, etc. Additionally, if desired, certain lifts and deadlifts can be performed by gripping the exercise device with both hands on the same hand grip 156, but on either side of center bar 158 or 160, so that each of the user's hands passes through one of the two windows in the side faces 130 or bottom face 120. Further, one handed deadlifts can be performed by placing the exercise device 100 on the floor, and by grasping the hand grip 158 or 160 while performing the lift. Other types of single handed lifts can be performed while holding the exercise device 100 by the hand grip 158 or 160, including, but not limited to, single arm presses and push presses, single press push jerks, single arm power snatches, etc., (see FIG. 10C).

Kettlebell exercises: A user can grasp the exercise device 100 by one hand grip 152, or by a pair of the hand grips 152 located on the same end face 140 (see, FIG. 10A) of the device 100, and swing the device 100 to perform different types of kettlebell swings. Additionally, one or more hand grips 152, 154 can be grasped while the exercise device is carried, as is done with kettlebell carries, kettlebell snatches and other kettlebell related exercises.

Sit-up anchor or weight: The exercise device 100 can be placed on the floor, and the user can place a portion of their feet into the open spaces 162 through the window panes of one of the side faces 130 or the bottom face 120, to anchor themselves during sit-ups. Additionally, weighted sit-ups can be performed while holding the exercise device 100 by an opposing pair of hand grips 152 or 154.

Push-up exercises: The exercise device 100 can be placed on the floor to assist the user with performing different types of push-ups. For example, the user may place the exercise device 100 on the ground, with the top face 110 pointing up, to assist with plyo push-ups, foot elevated push-ups, pike push-ups and hand elevated push-ups, among others.

Figure 10E:
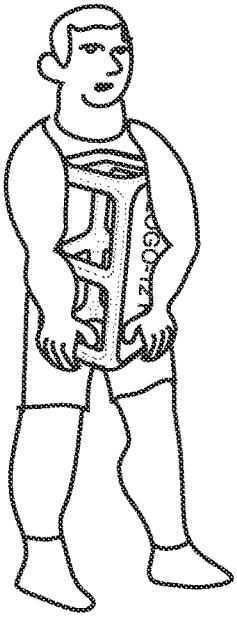
Figure 10D:
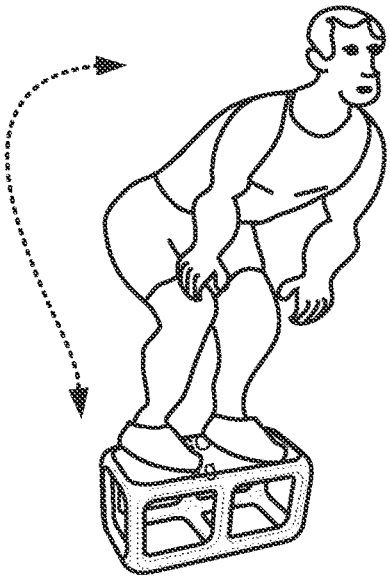

Ground block exercises: The exercise device 100 can be placed on the ground for use in performing certain exercises that do not involve holding the exercise device 100. For example, the exercise device 100 can be placed on the ground, with the top face 110 facing up, and the user can alternate tapping their feet on the top surface 110*a* of the exercise device 100, to perform toe taps and/or fast feet exercises. Similarly, the user can use the weighted exercise devices 100 to perform step-ups to repetitively step up onto, and down from, the exercise device 100 and box jumps, to repetitively jump up onto (see FIG. 10D), and down from, the exercise device 100. Additionally, the exercise device 100 can be used when performing exercises that do not involve touching the exercise device 100, such as lateral jumps and burpee block jumps, where the user jumps from one side of the exercise device 100 to the other, without touching it, and heel taps, where the seated user pivots their core to tap their heels on first one side of the block, then the other side.

Miscellaneous exercises: A further number of exercises can be performed while holding the exercise device 100. For example, the exercise device 100 can be held behind the head of the user by an opposing pair of hand grips 152 (i.e., on opposite sides of the body 100*a*) while bending forward from the waist, and back to a standing position to perform the "good morning" exercise. The exercise device 100 can additionally be held by an opposing pair of hand grips 152 or 154 while performing ab related exercises, weighted lunges, hip thrusts, and carries (see FIG. 10B), among others. Further still, the exercise device 100 can be grasped by a central hand grip 158 or 160 (see FIG. 10C), and carried, to perform farmer carries and/or shoulder carries. Also, the user can hold the device lengthwise against their chest, holding on to one of the bottom hand grips 154, 156, to emulate a bucket carry (see FIG. 10E). Further, two exercise devices 100 can be used together when performing exercises such as farmer carries.

Resistance exercises: If desired, the exercise device 100 can be used to form an anchor for using resistance bands, wherein the bands are secured about one of the hand grips 152, 154, 156, 158, 160 and exercises are performed using the resistance bands. If desired, a foot of the user may be placed against an edge 150 or hand grip 156 of the exercise device 100, while performing exercises with resistance bands.

It should be understood that other exercises can be performed with, and other uses made for, the exercise device 100, without departing from the scope or spirit of the present invention.

Figure 11:
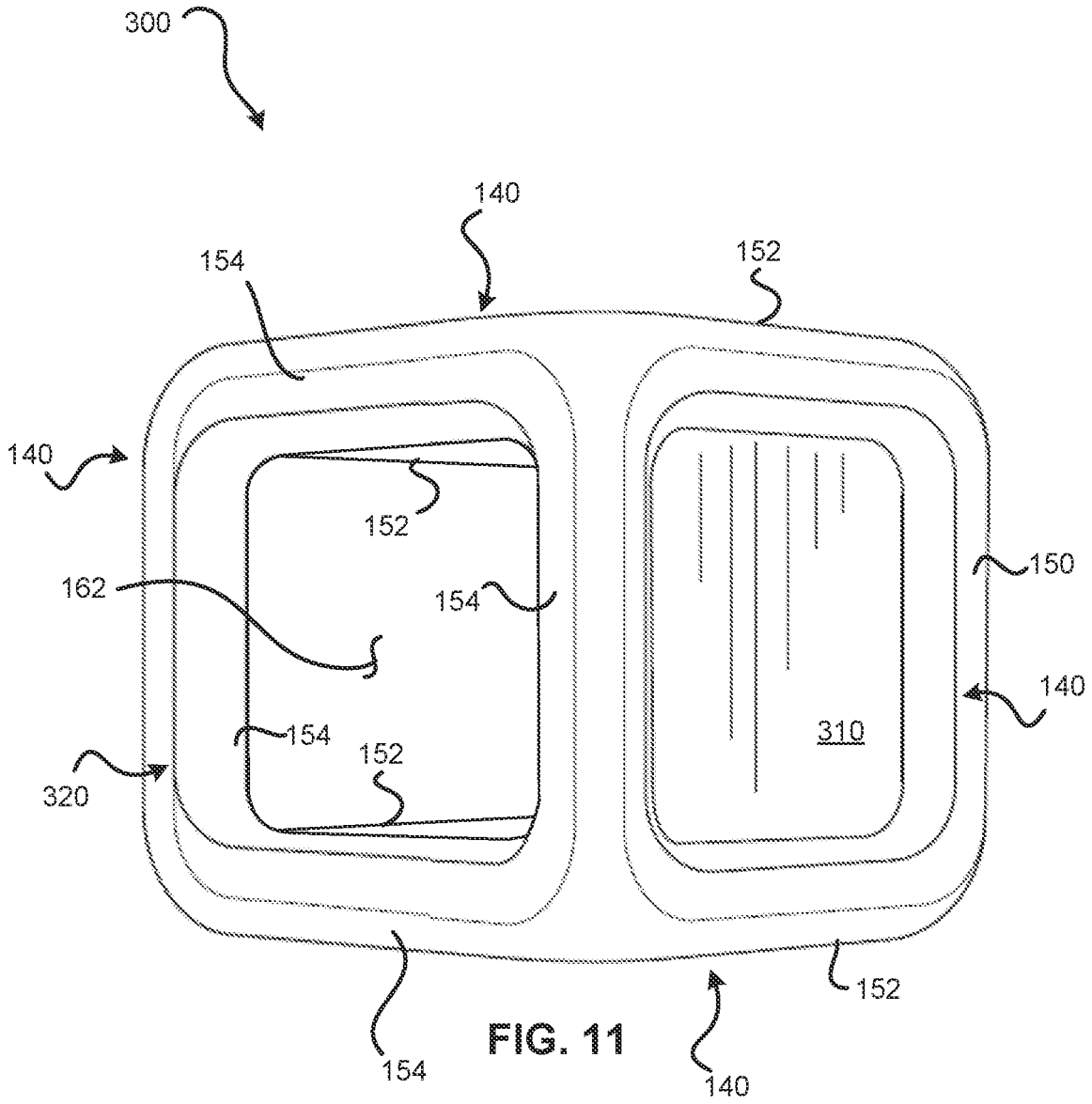
FIG. 11 is a perspective view taken from the bottom of an exercise device in accordance with another embodiment of the invention.

Additionally, it should be understood that the shape and form of the exercise device 100 can be modified and still be within the scope and spirit of the present invention. For example, FIG. 11 is a perspective view taken from the bottom of an exercise device 300 in accordance with another embodiment of the invention. The exercise device 300 is that special case of a rectangular prism in which all of the faces are squares, and thus, the device 300 is formed as a cube, having a closed top face 310 and an open framework body, similar to the open framework body 100*a* described in connection with FIGS. 3-8. In other words, the two side faces (130 of FIGS. 3-8) are formed as square end faces 140, in addition to the two previously square end faces 140, so that the body includes four end faces 140, each of which is as described in connection with end faces 140 of FIGS. 3-8. Thus, the four end faces 140 extend between an open bottom face 320 and a closed top face 310. The intersections of each end face with the bottom face 320 form a hand grip 154, as additionally described in connection with FIGS. 3-8. Likewise, the intersections of each of the end faces 140 with one another forms a further hand grip 152 in the height direction, between the top face 310 and the bottom face 320. Each end face 140 includes an open central portion 162, defined between a frame created by each end face 140's respective edge 150, shared with the top face 310, hand grip 154, at the interface between the end face 140 and the bottom face 320, and two hand grips 152 at the interfaces between the end face 140 and it's respective left and right neighboring (i.e., contiguous) end faces 140. As the present embodiment does not include longer side faces or a correspondingly long bottom face, the central hand grips of the previous embodiment have been omitted. The exercise device 300 can be used and manufactured in the same manner as described in connection with the FIGS. 3-10, including, if desired, provided as a system of differently weighted exercise devices, as described in connection with FIG. 9.

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

We claim:

1. A system of exercise devices, comprising:

a plurality of exercise devices, each exercise device of the plurality of exercise devices including:

a top face; and an open framework body permanently connected to said top face, said open framework body formed as a plurality of bar-shaped hand grips defining a plurality of planar faces, such that:

a respective hand grip of said plurality of hand grips is formed at each intersection between two contiguous faces of said plurality of faces;

said plurality of faces include at least two faces, each of said at least two faces extending from a different side of said top face, and each of said at least two faces being substantially perpendicular to said top face;

said plurality of faces further includes a bottom face substantially parallel to said top face;

each respective face of said at least two faces is defined by a different edge of said top face, and by hand grips of said plurality of hand grips formed at each intersection between the respective face and each contiguous neighboring face of said plurality of faces; and each face of said plurality of faces being open between said plurality of hand grips, with at least one face of said plurality of faces being completely open between respective hand grips of said plurality of hand grips; and the exercise device configured as a right rectangular prism with each of said at least two faces of said plurality of faces extending between said top face and said bottom face, intersections of each of said at least two faces with said bottom face forming a hand grip at an edge of said bottom face, said bottom face configured to rest directly on a support surface;

at least a portion of said top face being a solid, closed surface permanently connected between two opposite faces of said at least two faces of said open framework body; and each exercise device of said plurality of exercise devices having the same physical dimensions as the other exercise devices of said plurality of exercise devices and being a different weight from the other exercise devices of said plurality of exercise devices.

2. The system of exercise devices according to claim 1, wherein each exercise device of the plurality of exercise devices has a length to width to height ratio of 2:1:1, such that the width and the height of the exercise device have the same dimension and the length of the exercise device is twice the dimension of the width and the height.

3. The system of exercise devices according to claim 2, wherein said at least two faces are four faces and each of said four faces forms a hand grip at an edge of said bottom face.

4. The system of exercise devices according to claim 3, wherein said four faces include two end faces and two side faces, each side face having a greater length than each end face, and wherein each side face includes a further hand grip not formed at an intersection with a contiguous face.

5. The system of exercise devices according to claim 4, wherein said further hand grip is a central hand grip centered in said side face, and said side face is open between said central hand grip and each hand grip formed at the intersection with another face of said four faces.

6. The system of exercise devices of claim 2, wherein the length of each exercise device is 400 mm and each of the width of each exercise device and the height of each exercise device are 200 mm.

7. The system of exercise devices according to claim 1, wherein said top face is a closed top face without hand grips.

8. The system of claim 1, wherein the top face and the open framework body are formed from cast iron.

9. The system of claim 8, wherein said cast iron of each exercise device of said plurality of exercise devices is overmolded with rubber.

10. A method of using an exercise device, comprising the steps of:

providing the system of exercise devices according to claim 1;

selecting one exercise device from the plurality of exercise devices; and using the selected exercise device to perform an exercise.

11. The system of exercise devices according to claim 1, wherein said open framework body has an open interior.

12. The system of exercise devices according to claim 1, wherein:

said top face and said open framework body together form a single piece; and at least a majority portion of said top face being a solid, closed surface permanently connected between two opposite faces of said at least two faces of said open framework body.

13. The exercise device according to claim 12, wherein said top face includes pierced portions to form top face hand grips at the intersecting edges of said top face and said at least two faces, a remaining portion of said top face being closed.

14. The system of exercise devices according to claim 12, wherein said bottom face further includes a central hand grip disposed between two opposing edges of said bottom face to bisect said bottom face.

15. The system of exercise devices according to claim 1, wherein said top face includes pierced portions to form top face hand grips at the intersecting edges of said top face and said at least two faces, a remaining portion of said top face being closed.

16. The system of exercise devices according to claim 1, wherein said bottom face further includes a central hand grip disposed between two opposing edges of said bottom face to bisect said bottom face.

* * * * *